US007013693B2

(12) United States Patent
Noe

(10) Patent No.: US 7,013,693 B2
(45) Date of Patent: Mar. 21, 2006

(54) METHOD OF AND APPARATUS FOR THE CONTINUOUS STRETCH LEVELING OF METALLIC STRIP

(75) Inventor: Andreas Noe, Kerken (DE)

(73) Assignee: BWG Bergwerk- und Walzwerk-Maschinenbau GmbH, Duisburg (DE)

( * ) Notice: Subject to any disclaimer, the term of this patent is extended or adjusted under 35 U.S.C. 154(b) by 0 days.

(21) Appl. No.: 10/846,158

(22) Filed: May 13, 2004

(65) Prior Publication Data

US 2005/0016241 A1 Jan. 27, 2005

(30) Foreign Application Priority Data

May 23, 2003 (DE) ..... 103 23 811

(51) Int. Cl.
*B21D 1/05* (2006.01)

(52) U.S. Cl. ..... 72/161; 72/205

(58) Field of Classification Search ..... 72/161, 72/205, 183

See application file for complete search history.

(56) References Cited

U.S. PATENT DOCUMENTS

| | | | | | |
|---|---|---|---|---|---|
| 2,432,828 | A | * | 12/1947 | Stone | 72/160 |
| 3,777,532 | A | * | 12/1973 | Noe | 72/205 |
| 4,079,615 | A | * | 3/1978 | Noe | 72/205 |
| 4,819,470 | A | * | 4/1989 | Noe et al. | 72/161 |
| 5,341,664 | A | * | 8/1994 | Noe et al. | 72/161 |
| 6,732,561 | B1 | * | 5/2004 | Voges | 72/161 |

FOREIGN PATENT DOCUMENTS

| | | | |
|---|---|---|---|
| DE | 39 12 676 | | 10/1990 |
| DE | 42 30 243 | | 1/1994 |
| DE | 197 19 994 | | 11/1998 |
| DE | 101 14 883 | | 10/2002 |
| GB | 1473159 | * | 5/1977 |

* cited by examiner

*Primary Examiner*—Daniel C. Crane
(74) *Attorney, Agent, or Firm*—Herbert Dubno

(57) ABSTRACT

A tension leveling system for thin metal strip has between a brake roll set and a tension roll set, additional two-roll bridles in which one or more inlet stretch leveling regions are followed by an elastic deformation region and the latter is followed by one or more stretch leveling regions. The stretch leveling regions can effect plastic deformation.

10 Claims, 4 Drawing Sheets

METHOD OF AND APPARATUS FOR THE CONTINUOUS STRETCH LEVELING OF METALLIC STRIP

FIELD OF THE INVENTION

My present invention relates to a method of continuously stretch leveling metal strip, especially strip with a thickness of 0.05 mm to 1.5 mm. The invention also relates to an apparatus which utilizes that method and to a method of operating the apparatus.

The invention especially relates to the continuous stretch leveling of metal strip of a thickness o 0.05 mm to 1.5 mm in which the strip passes from a braking-roll set, usually a four-roll bridle to a tensioning roll set, likewise usually a four-roll bridle, and is subjected between the two roll sets to a stretching in the plastic deformation range of the strip (hereinafter also referred to as the plastic range) to effect a straightening or leveling, i.e. an improvement in the planarity of the strip. A leveling in the plastic range can also be referred to as an elastic-plastic leveling since, in exceeding the elastic limit of the strip material as is required at the transition from the elastic range to the plastic range, there is some remaining residual elasticity in the strip material.

BACKGROUND OF THE INVENTION

It is known to level this metal strip by a tension leveling process or in a tension leveling apparatus which has a brake roll set and a tension roll set. Both roll sets have as a rule two or more rolls which are looped by the strip.

For stretch leveling, a strip can be passed in such manner about two or more rolls which are operated with stepped torques or peripheral speeds so that between two rolls a stretching tension can be applied. Between the brake rolls sets and the tension roll sets, therefore, there can be a region in which the strip is subjected to tension, is stretched and is leveled.

In stretch leveling, there is a plastic elongation of the strip and a reduction of the strip thickness and strip widths. In prior systems, longitudinal stresses were produced and as a result of them, transverse stresses were created in the strip. As a consequence, greater longitudinal deformation could occur in the middle of the strip than would be present outwardly of the middle of the strip, resulting in residual stresses which were not uniform across the width of the strip.

To minimize the deformation which arose through stretch leveling and thus the central dishing of the strip and the nonuniform distribution of residual stresses therein, it has been proposed to provide between the braking roll set and the tensioning roll set a tension leveling roll path creating a stretching tension in the strip in the plastic range (see DE 39 122 676 C2).

OBJECTS OF THE INVENTION

It is the principal object of the present invention to provide a method of continuous stretch leveling of metal strip in which improved and even optimal planarity results can be achieved.

Another object of the invention is to provide a method of continuously stretch leveling metal strip of a thickness of 0.05 mm to 1.5 mm whereby problems which have been encountered with strip of such thicknesses heretofore are no longer a difficulty.

Still another object of this invention is to provide a method of stretch metal leveling strip which yields a product having fewer stresses or uncompensated stresses and which generally can be considered an improved product by comparison with prior art strip.

A further object of this invention is to provide an improved apparatus for stretch leveling metal strip.

Yet another object is to provide an improved method of operating an apparatus for stretch leveling a metal strip.

SUMMARY OF THE INVENTION

These objects are attained in a method of continuously stretch leveling metal strip which comprises the steps of:

(a) passing a metal strip, preferably of a thickness of 0.05 nm to 1.5 mm, continuously from a braking roll set to a tensioning roll set across a stretching path between the roll sets;

(b) forming over the stretching path a succession of at least three distinct stretching zones; and (c) controlling stretching of the strip in the stretching zones to effect at least elastic stretching of the strip therein.

The method can be practiced with an apparatus which comprises:

a braking roll set and a tensioning roll set spaced apart across a stretching path between the roll sets and traversed by the metal strip;

a plurality of roll-pair bridles engaging the strip within the stretching path and defining a succession of at least three distinct stretching zones; and controls for the rolls of the roll-pair bridles for controlling stretching of the strip in the stretching zones to effect at least elastic stretching of the strip therein.

The method of operating the stretch leveling apparatus can comprise the steps of:

(a) passing a metal strip of a thickness of 0.05 mm to 1.5 mm continuously from a braking roll set in the form of a four-roll bridle to a tensioning roll set in the form of a four-roll bridle operating with roll peripheral speeds in excess of roll peripheral speeds of the braking roll set across a stretching path between the roll sets;

(b) forming over the stretching path a succession of at least three distinct stretching zones including a first stretching zone defined between a first pair of rolls looped by the strip, a second stretching zone defined between a second pair of rolls looped by the strip and a third stretching zone defined between a third pair of rolls looped by the strip, each of the pairs of rolls including a downstream roll having a peripheral speed greater than an upstream roll of the respective pair; and (c) controlling stretching of the strip in the stretching zones to effect at least elastic stretching of the strip in all of the zones and plastic stretching of the strip in at least one of the zones.

More particularly, according to the invention, between the two-roll sets and, preferably, a braking and tension roll set each of which comprises a four-roll set, each of which comprises a four-roll bridle, there are provided three or more stretching zones and in each of these stretching zones, there is a plastic deformation (elastic-plastic stretching) and/or a stretching in the elastic range. The third zone and, where provided, additional stretching zones quite surprisingly have been shown to give rise to a homogenization of the longitudinal stress distribution and the resulting length and width changes in the strip. The result is an optimum leveling or straightening and a significantly improved planarity of the strip.

According to the invention, the strip can be stretched in all of the three or more stretching zones in the plastic range. Preferably in accordance with the invention, however, when there are three such stretching zones, the strip is stretched in the inlet and outlet stretching zones in the plastic range and in the intermediate stretching zones between the inlet and outlet zones, i.e. in a middle zone, with a strip tension which lies only in the elastic range. The result is a rounding in the yield curve in the tension-yield diagram upon exceeding the elastic limit between the elastic and plastic region, apparently because the strip in the middle stretching zone represents a relief from the prior plastic deformation and itself has stresses which are eliminated in the subsequent plastic deformation. To optimize this effect, the strip tension in the central zone is ≦80% (less than or equal to 80%), preferably ≦50% of the elastic limit of the strip material. The strip should have a residence time in the central stretching zone ≦1 second (at least one second).

If, in accordance with the invention, there are more than three stretching zones between the tension and braking bridles, for example five stretching zones, the central stretching zones will be operated in the elastic range while the first two and last two stretching zones will be operated in the plastic range. In this case, whether the system has three, five or more stretching zones, the inlet and outlet stretching zones will operate in the plastic range while the central stretching zone can always be operated in the elastic range. The result is a system which has a particularly compact construction. Of course it is possible to coil the strip after it has traversed the inlet-side stretching zone or zones and to store the coil before the strip is uncoiled and subjected to the second, third or additional stretching operations. The intervening coiling has been found, surprisingly, to eliminate creep effects when the strip is subsequently coiled.

According to the invention, moreover, where the stretching zones are defined between rolls which are looped by the strip, each pair of such rolls can have at least the tension side roll of the respective pair formed as a concave/convex stretching roll with a variable geometry. With such tension rolls, the roll periphery can be adjustable between a convex or crown configuration and a concave configuration to enable dishing at the center of the strip and corrugations or waviness at the edges to be reduced or completely eliminated (see DE 42 30 243 C1).

To the extent that the apparatus must be matched to different strip widths, the strip can be subjected to the effect of one or more linear motors in specific stretching zones. The use of linear motors in inductive stretching of the middle strip is especially effective for nonferromagnetic materials, for example, bundmetal (zinc, copper, aluminum alloys) and enables a highly sensitive and precise adjustment of the stress distribution (see especially DE 197 19 994 A1).

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
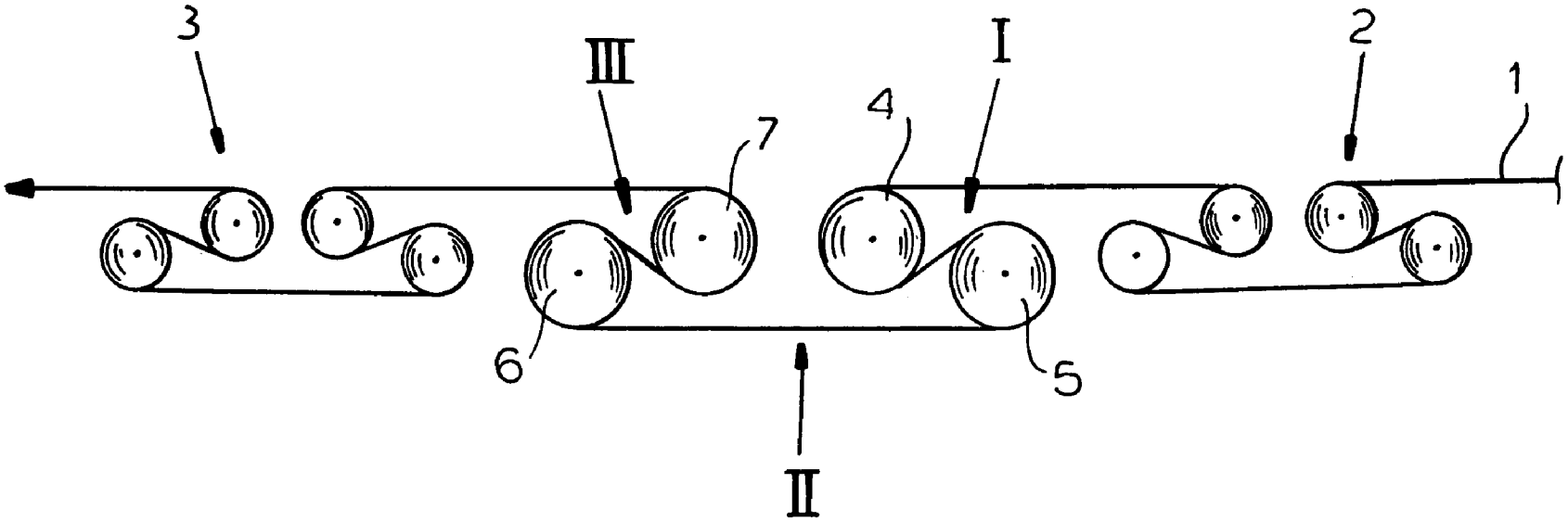
FIG. 1 is a diagram of a stretch leveling apparatus having three stretching zones as described herein and in a side view.

In FIG. 1 I have shown a stretch leveling apparatus for the continuous stretch leveling or tension leveling of thin metal strip 1 which can be composed of steel, stainless steel, aluminum, other nonferrous metal or the like, preferably a strip thickness between 0.05 mm and 1.5 mm.

In its basic construction the apparatus comprises a four-roll braking roll set or bridle 2 and a four-roll bridle forming a tension roll set 3. The tension roll set operates with a peripheral speed of its rollers which is greater than that of the braking roll set 2 and there is a stretch between the two-roll sets in which stretching of the strip is effected.

More particularly, there are in this stretch two stretching roll pairs or two-roll bridles 4, 5 and 6, 7 which define an inlet side stretching zone I between the two rolls 4, 5, an outlet side stretching zone III between rolls 6 and 7 and a central or intermediate leveling zone II between the two roll pairs 4, 5 and 6, 7. The roll 5 operates with a torque and a peripheral speed greater than the torque and peripheral speed of the roll 4. Roll 6 operates with a torque greater than that of roll 5 and roll 7 operates with a peripheral speed and torque greater than those of roll 6. At least the rolls 4 and 6, i.e. the upstream roll of the pairs 4, 5 and 6, 7 can be a concave/convex adjustable contour roll. In addition, the strip 1 in the individual stretching zones I, II, III can be acted upon by one or more linear motors as described in DE 197 19 994 A1.

Figure 2:
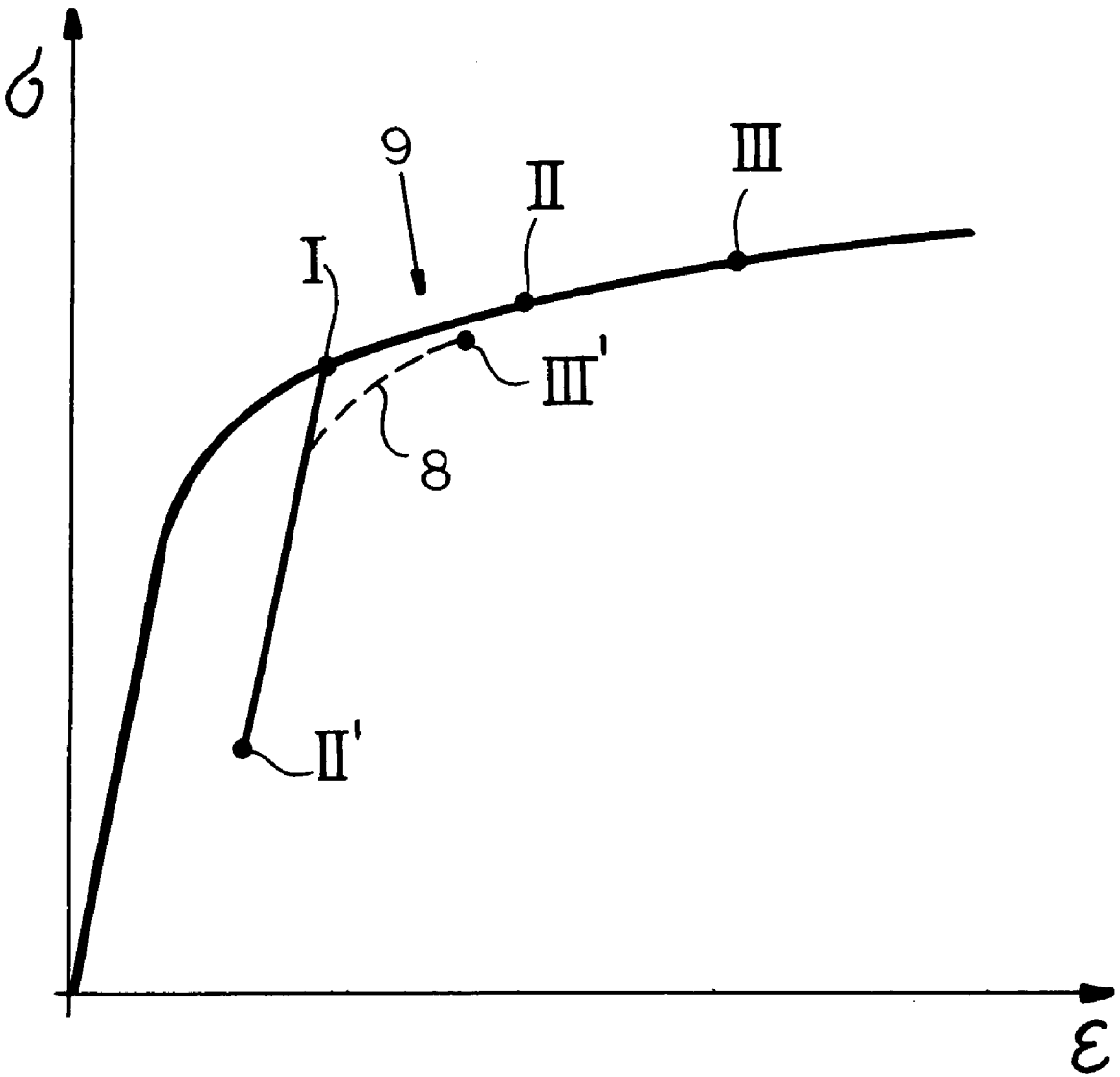
FIG. 2 is a tension yield diagram illustrating principles of the invention.

In the travel of the strip 1 between the braking roll set 2 and the tension roll set 3, therefore, the strip traverses the leveling zones I, II and III in which the strip is leveled by tension in the plastic range and/or the elastic range. Preferably in the inlet leveling zone I and the outlet leveling zone III, the stretch leveling is effected in the plastic range and in the intermediate zone II only with a strip tension in the elastic range. The result is a rounding 8 of the yield curve 9 (FIG. 2) which is a tension versus yield diagram for this strip, upon exceeding the elastic limit of the strip material. The yield curve has been shown for a stretching in the three regions I, II and III, all in the plastic range as well as for a stretch leveling in which there is an intermediate tension relief in the intermediate stretching zone. The three stage operation with plastic deformation in each stage is shown at I-II-III, while the intermediate relief and subsequent plastic deformation is represented at I'-II'-III' corresponding to only elastic leveling in the intermediate zone. The rounding 8 of the yield curve represented in broken lines in FIG. 2 becomes increasingly significant, the longer the residence of the strip in the intermediate leveling zone, i.e. in the elastic range.

Figure 3:
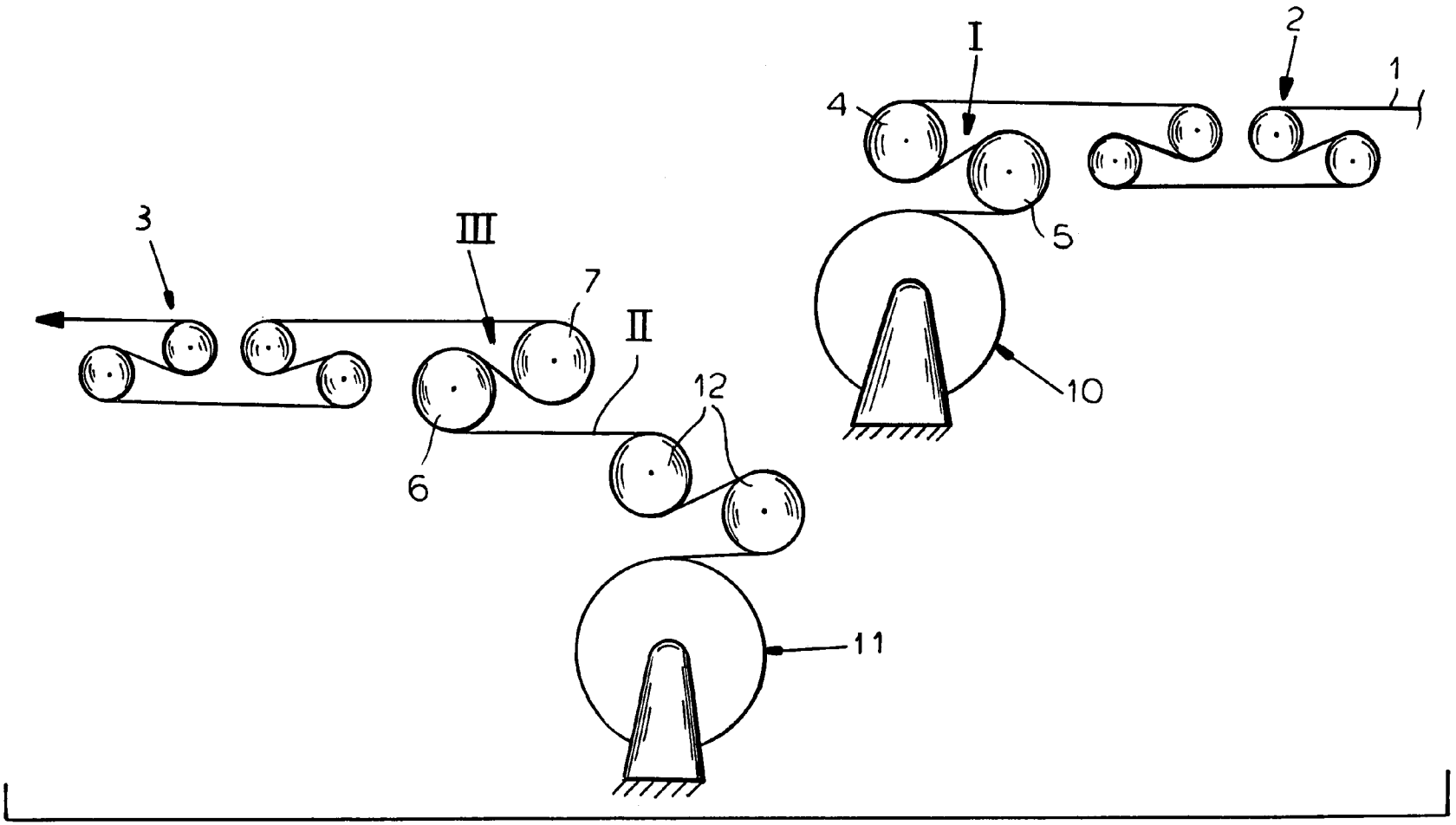
FIG. 3 is a view of an apparatus with winding of the strip into a coil after the initial product range stretching or stretchings.

In FIG. 3, I have shown an intermediate coiling of the strip 1 on the coil-winding unit 10. The strip can subsequently be fed from the coil unwinding unit 11 over the bridle 12 to the roll pair 6, 7 as has previously been described.

Figure 4:
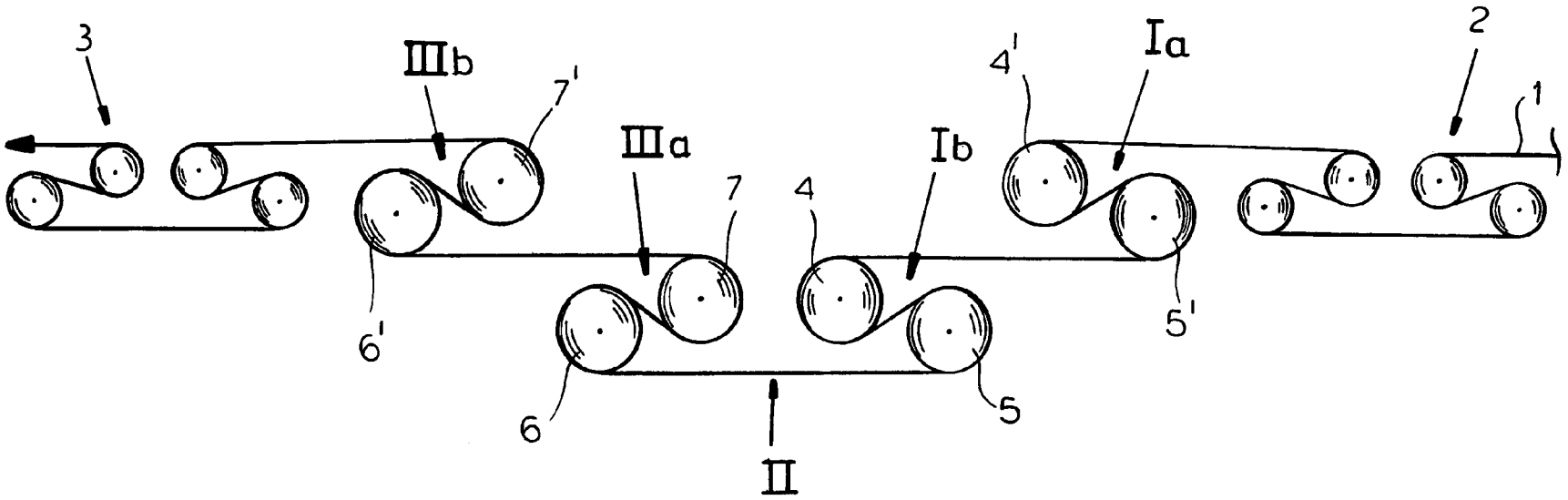
FIG. 4 is a diagram similar to FIG. 1 but showing an apparatus having 5 stretching zones.

Finally in FIG. 4, which has five stretching zones, note that the inlet side plastic stretching is effected at Ia, Ib between the rolls 4', 5' and 4, 5 while the outlet side plastic stretching is effected at IIIa, IIIb between the rolls 6, 7 and 6', 7' while the intermediate stretching at II is in the elastic range.

I claim:

1. A method of continuously stretch leveling metallic strip, especially with a strip thickness of 0.05 mm to 1.5 mm, in which the respective strip passes through a braking roll set and a tensioning roll set and between the two roll sets in the course of its stretching is subjected to a stretching tension in the plastic range, characterized in that the strip between both roll sets traverses an inlet-side stretch leveling zone at the braking roll set between two stretch-leveling rolls on an inlet-side stretch-leveling roll pair, an outlet-side stretch-leveling zone at the tension roll set between two stretch-leveling rolls of an outlet side stretch-leveling roll pair, and an intermediate stretch-leveling zone located between the inlet-side and outlet-side stretch-leveling zones and between the two stretch-leveling roll pairs, and, in these stretch-leveling zones, stretching the strip in a plastic and/or elastic range.

2. The method defined in claim 1 wherein at least in some of said stretch-leveling zones a plastic-range stretching of said strip is effected.

3. The method defined in claim 2 wherein the strip is stretched in a plastic deformation range in all of said stretch-leveling zones.

4. The method defined in claim 1 wherein in the intermediate stretch-leveling zone the strip tension lies in a plastic deformation range of the strip.

5. The method defined in claim 4 wherein the strip tension in said central zone is ≦80% of the elastic limit of the strip.

6. The method defined in claim 5 wherein the strip tension in said central zone is ≦50% of the elastic limit of the strip.

7. The method defined in claim 4 wherein the strip traverses said intermediate stretch-leveling zone with a residence time therein of ≦1 second.

8. A method of continuously stretch leveling metal strip which comprises the steps of:

(a) passing a metal strip of a thickness of 0.05 mm to 1.5 mm continuously from a braking roll set to a tensioning roll set across a stretching path between said roll sets;

(b) forming over said stretching path a succession of at least three distinct stretching zones; and (c) controlling stretching of said strip in said stretching zones to effect at least elastic stretching of said strip therein, and wherein at least in some of said stretching zones a plastic stretching of said strip is effected therein, five of said stretching zones being provided including two inlet-side stretching zones, a central stretching zone and two outlet-side stretching zones, the strip tensions in each of said inlet-side and outlet-side stretching zones lying in plastic deformation ranges of the strip, and the strip tension in said central stretching zone lying in an elastic deformation range of the strip.

9. The method defined in claim 8, further comprising the step of coiling the strip after said strip traverses at least one of said inlet-side stretching zones of said succession.

10. An apparatus for continuously stretch leveling metal strip of a thickness of 0.05 mm to 1.5 mm which comprises:

a braking roll set and a tensioning roll set spaced apart across a stretching path between said roll sets and traversed by said metal strip;

a plurality of roll-pair bridles engaging said strip within said stretching path and defining a succession of at least three distinct stretching zones; and controls for the rolls of said roll-pair bridles for controlling stretching of said strip in said stretching zones to effect at least elastic stretching of said strip therein, an inlet-side roll of at least one of said roll-pair bridles being of concave or convex variable adjustable geometry.

* * * * *